US009169986B2

(12) United States Patent
Lee

(10) Patent No.: US 9,169,986 B2
(45) Date of Patent: Oct. 27, 2015

(54) HEAD LIGHT MODULE

(71) Applicant: Hyundai Motor Company, Seoul (KR)

(72) Inventor: Seonghoon Lee, Hwaseong-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 131 days.

(21) Appl. No.: 14/143,395

(22) Filed: Dec. 30, 2013

(65) Prior Publication Data

US 2015/0062944 A1 Mar. 5, 2015

(30) Foreign Application Priority Data

Aug. 28, 2013 (KR) ..... 10-2013-0102437

(51) Int. Cl.
*F21S 8/10* (2006.01)

(52) U.S. Cl.
CPC ..... *F21S 48/1778* (2013.01)

(58) Field of Classification Search
CPC ..... F21S 48/1778
USPC ..... 362/512, 539
See application file for complete search history.

(56) References Cited

U.S. PATENT DOCUMENTS

| | | | | |
|---|---|---|---|---|
| 8,007,151 | B2 | 8/2011 | Tajima | |
| 2003/0235056 | A1* | 12/2003 | Jong | 362/512 |
| 2012/0113663 | A1* | 5/2012 | Kim | 362/513 |
| 2012/0188784 | A1 | 7/2012 | Abe | |
| 2015/0062944 | A1* | 3/2015 | Lee | 362/512 |

FOREIGN PATENT DOCUMENTS

| | | | |
|---|---|---|---|
| JP | 2001-319506 | A | 11/2001 |
| JP | 2002-56708 | A | 2/2002 |
| KR | 10-2011-0035601 | A | 4/2011 |
| KR | 1020120050271 | A | 5/2012 |

* cited by examiner

*Primary Examiner* — David V Bruce
(74) *Attorney, Agent, or Firm* — Morgan, Lewis & Bockius LLP

(57) ABSTRACT

A head light module includes: a lamp disposed to irradiate light; a shield disposed to be rotatable about a rotating pin so as to selectively block a light path of a portion of the light irradiated from the lamp; a plunger disposed to be moved in a longitudinal direction thereof in order to push or pull one side of the shield; a compressive roll pad disposed so that an outer circumferential surface thereof is in contact with the plunger, rotated in accordance with a forward and rearward movement of the plunger, and compressed by the plunger or returns back to an original shape thereof when the plunger is moved forward or rearward; and an actuator which moves the plunger forward or rearward so that the shield selectively blocks the light path of a portion of the light irradiated from the lamp.

8 Claims, 8 Drawing Sheets

HEAD LIGHT MODULE

CROSS-REFERENCE TO RELATED APPLICATION

The present application claims priority of Korean Patent Application Number 10-2013-0102437 filed Aug. 28, 2013, the entire contents of which application is incorporated herein for all purposes by this reference.

BACKGROUND OF INVENTION

1. Field of Invention

The present invention relates to a head light module which improves driving convenience of a driver by selectively irradiating a low beam and a high beam in accordance with a mode and reduces noise that occurs when the mode is converted.

2. Description of Related Art

A head light module, also called a headlamp, is a device that serves to illuminate a forward path on which a vehicle runs, and requires brightness to enable a driver to verify obstacles on a road, which are 100 m from the front of the vehicle, at night.

A headlamp assembly of the related art (Japanese Patent Laid-Open Publication No. 2001-110213) includes a bulb (lamp), a reflector which supports the bulb and reflects forward light irradiated from the bulb, and a lens connected to a front side of the reflector by a holder.

The head light module is configured so that light irradiated from the bulb is converted into a low beam or a high beam by an operation of a shield unit provided in the head light module.

The shield unit includes a rotating pin, and a plate-shaped shield that is rotated about the rotating pin, and in this case, light irradiated from the bulb may be converted into a low beam or a high beam in accordance with a degree of rotation of the shield according to a linear movement of a solenoid.

Accordingly, a low beam state is made in an initial state in which the solenoid is not operated, and a high beam state is made when the shield is rotated forward about the rotating pin as the solenoid is linearly moved forward.

Meanwhile, the rotational operation of the shield of the shield unit is stopped by a damper (stopper), and in this case, noise and vibration occur due to a collision between the shield and the damper, and the noise and the vibration may be displeasing to the driver. Therefore, researches are continuously conducted to reduce noise and vibration occurring in the shield unit.

The information disclosed in this Background section is only for enhancement of understanding of the general background of the invention and should not be taken as an acknowledgement or any form of suggestion that this information forms the prior art already known to a person skilled in the art.

BRIEF SUMMARY

Various aspects of the present invention provide for a head light module which prevents dissatisfaction a driver by reducing noise and vibration that occur due to a collision between a shield and a damper when a rotational operation of the shield of a shield unit is stopped by the damper (stopper).

Various aspects of the present invention provide for a head light module including: a lamp which is disposed to irradiate light; a shield which is disposed to be rotatable about a rotating pin so as to selectively block a movement path or light path of a portion of the light irradiated from the lamp; a plunger which is disposed to be moved in a longitudinal direction thereof in order to push or pull one side of the shield; a compressive roll pad which is disposed so that an outer circumferential surface thereof is in contact with the plunger, rotated in accordance with a forward and rearward movement of the plunger, and compressed by the plunger or returns back to an original shape thereof when the plunger is moved forward or rearward; and an actuator which moves the plunger forward or rearward so that the shield selectively blocks the movement path of a portion of the light irradiated from the lamp.

The head light module may further include a plunger pin which is formed to protrude on one side surface of the plunger; a pad pin which is disposed on a rotation center portion of the compressive roll pad; a connecting arm which connects the plunger pin and the pad pin; a forward and rearward guide which guides the movement of the plunger pin; and an inclined guide which guides a movement of the pad pin.

The head light module may further include a drive arm having one end portion hinge-coupled to a front end portion of the plunger, and the other end portion hinge-coupled to the shield, such that the plunger rotates the shield.

The head light module may further include a shield mounting bracket on which the shield is installed so as to be rotatable through the shield rotating pin.

The head light module may further include a damper which is disposed between the shield mounting bracket and the shield so as to attenuate an impact occurring between the shield mounting bracket and the shield.

While the plunger is moved rearward and the shield is rotated about the shield rotating pin, the compressive roll pad may be compressed by the plunger, a movement speed of the plunger may be reduced by the compression force, and an impact occurring at the damper may be reduced.

The damper may be fixed to the shield mounting bracket, and a rotational operation of the shield may be stopped by the damper in accordance with a forward or rearward movement of the plunger.

The compressive roll pad may be an elastic member capable of being compressed by being pressed by the plunger, and expanded to return back to an original shape thereof.

According to the head light module of the present invention, when the plunger is moved rearward, a rotational operation of the shield is interrupted by the damper, whereas a rearward speed of the plunger is reduced by energy by which the plunger compresses the compressive roll pad, and noise and vibration occurring between the shield and the damper are effectively reduced.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 1:
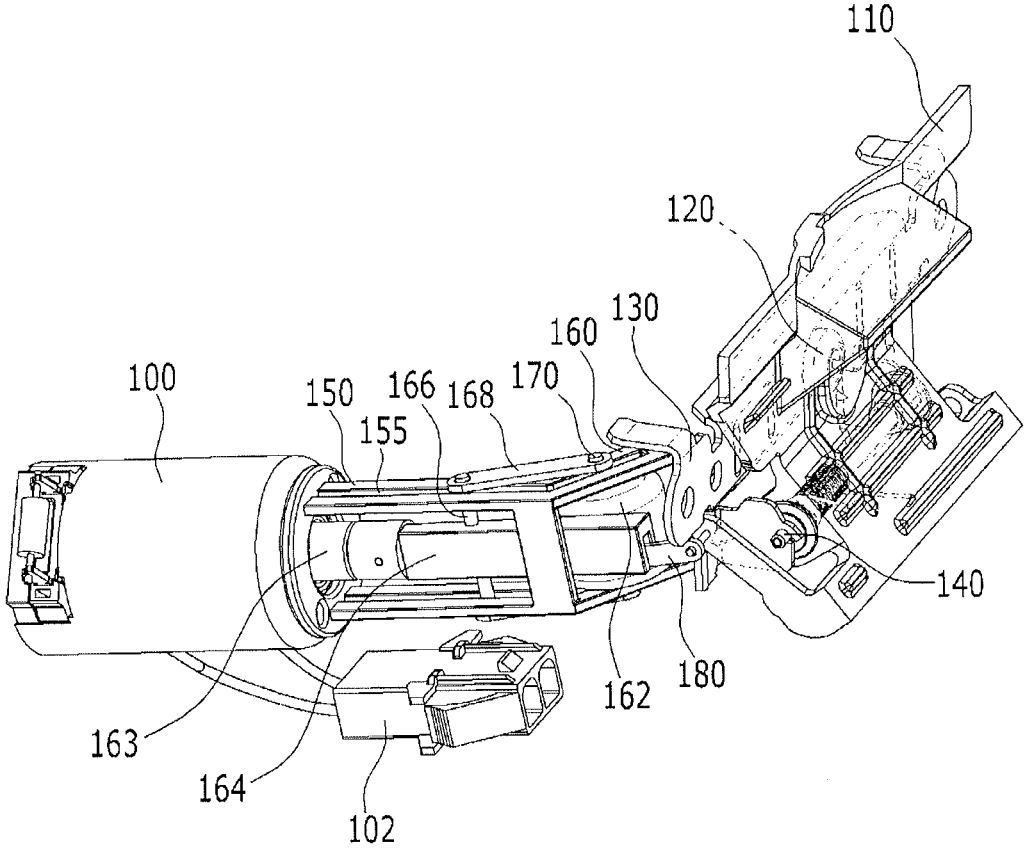
FIG. 1 is a perspective view of a shield unit of a head light module of the related art.

FIG. 1 is a perspective view of a shield unit of a head light module of the related art.

Referring to FIG. 1, a shield unit includes an actuator 100, a forward and rearward guide 150 having a guide slot 155 formed therein, a plunger pin 166, a connecting arm 168, a pad pin 170, an inclined guide 160, a shield mounting bracket 130, a damper 120, a shield 110, a rotating pin 140, a drive arm 180, a compressive roll pad 162, a power source socket 102, an actuator plunger 163, and a plunger 164.

The shield 110 is mounted to the shield mounting bracket 130 so as to be rotatable about the rotating pin 140. The damper 120 serves to absorb an impact between the mounting bracket 130 and the shield 110.

One side of the shield 110 is connected to the drive arm 180, and the drive arm 180 is connected to the plunger 164. The actuator plunger 163 is formed to protrude at a center of a front end portion of the actuator 100, and a front end portion of the actuator plunger 163 is fixed to a rear end portion of the plunger 164 by a pin or the like.

The actuator plunger 163 and the plunger 164 are disposed to be moved as a single body forward and rearward by the actuator 100.

The plunger pin 166 is formed to protrude on one side surface of the plunger 164, and the plunger pin 166 is inserted into the guide slot 155 of the forward and rearward guide 150. Therefore, the plunger 164 is disposed to reciprocate forward and rearward along the guide slot 155.

A front end portion of the plunger 164 is connected to the drive arm 180 by a hinge, and the rear end portion of the plunger 164 is connected to the actuator 100.

The actuator 100 may include a solenoid (not illustrated), and the power source socket 102 supplies external power to the actuator 100 through an electric wire.

In various embodiments of the present invention, the plunger pin 166 and the pad pin 170 are connected to each other through the connecting arm 168, and the compressive roll pad 162 may be moved forward and rearward by movements of the plunger 164 and the plunger pin 166.

An outer circumferential surface of the compressive roll pad 162 is in close contact with the plunger 164, the pad pin 170 is disposed on a rotation center portion of the compressive roll pad 162, and the pad pin 170 is moved along a slot of the inclined guide 160.

In addition, even though the forward and rearward guide 150 and the inclined guide 160 are connected to each other, because the slot of the inclined guide 160 is disposed to be inclined with respect to a direction of the guide slot 155 of the forward and rearward guide 150, the pad pin 170 may be moved close to or away from the plunger 164 when the plunger 164 is moved forward and backward.

When the plunger 164 is moved forward, a distance between one surface of the plunger 164 and the pad pin 170 is increased such that the compressive roll pad 162 is not compressed, or is slightly compressed by the plunger 164.

Further, when the plunger 164 is moved rearward, the distance between the one surface of the plunger 164 and the pad pin 170 is decreased such that the compressive roll pad 162 is compressed by the plunger 164.

In addition, when the plunger 164 is moved rearward, a rotational operation of the shield 110 is interrupted by the damper 120, and a rearward speed of the plunger 164 is reduced due to energy by which the plunger 164 compresses the compressive roll pad 162, such that noise and vibration, which occur between the shield 110 and the damper 120, are reduced.

Figure 2:
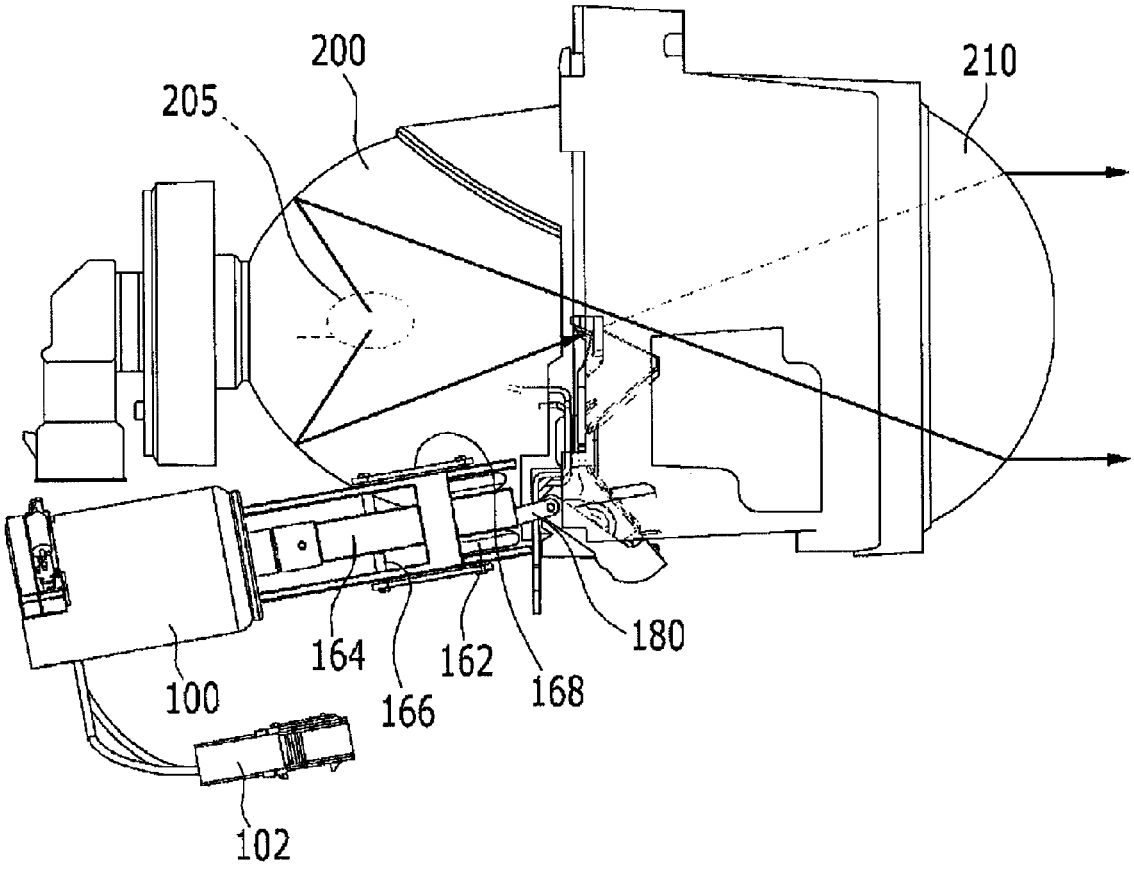
FIG. 2 is a side view illustrating a low beam state of an exemplary head light module according to the present invention.

FIG. 2 is a side view illustrating a low beam state of a head light module according to various embodiments of the present invention.

Referring to FIG. 2, a lamp (bulb) 205 is disposed to be fixed in a reflector 200, a lens 210 is disposed in front of the lamp 205, and light irradiated from the lamp 205 is reflected by the reflector 200 and then irradiated forward through the lens 210.

As illustrated, the light irradiated through the lens 210 includes a high beam that is irradiated toward a higher portion, and a low beam that is irradiated toward a lower portion.

Further, when the plunger 164 is moved rearward by the actuator 100, the shield 110 is rotated counterclockwise so as to be vertically disposed, the high beam irradiated through the reflector 200 is blocked, and only the low beam is irradiated forward through the lens 210.

Figure 3:
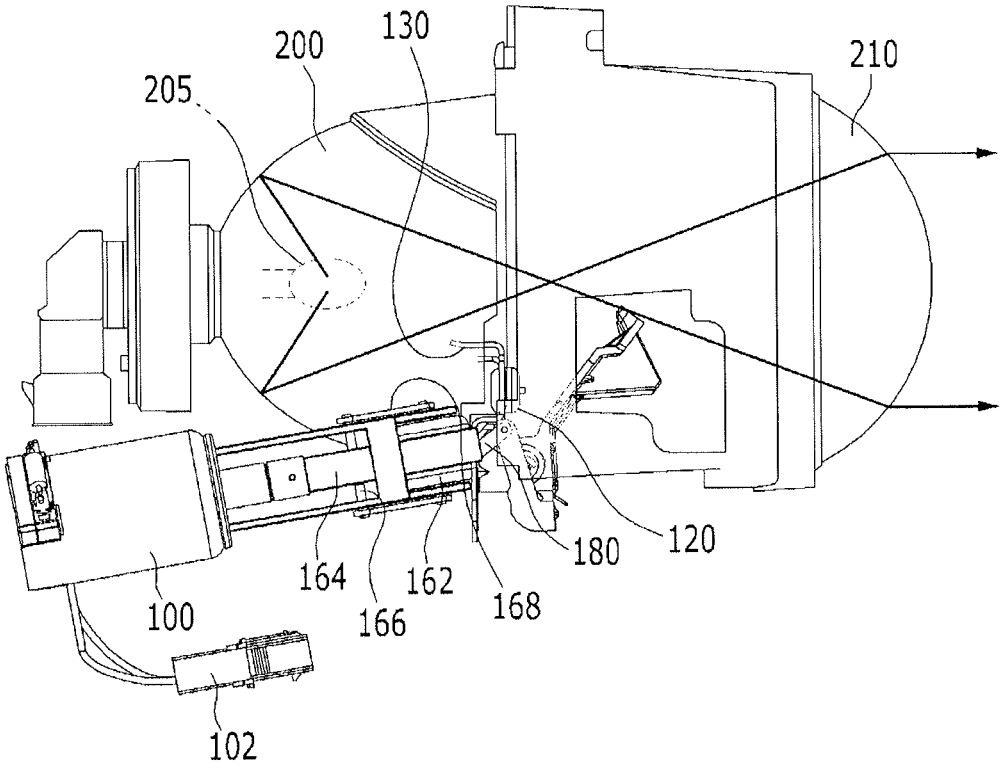
FIG. 3 is a side view illustrating a high beam state of the exemplary head light module according to the present invention.

FIG. 3 is a side view illustrating a high beam state of the head light module according to various embodiments of the present invention.

Referring to FIG. 3, the light irradiated through the lens 210 includes the high beam that is irradiated toward a higher portion, and the low beam that is irradiated toward a lower portion.

Further, when the plunger 164 is moved forward by the actuator 100, the shield 110 is rotated clockwise, and the high beam and the low beam irradiated through the reflector 200 are irradiated forward through the lens 210.

Figure 4:
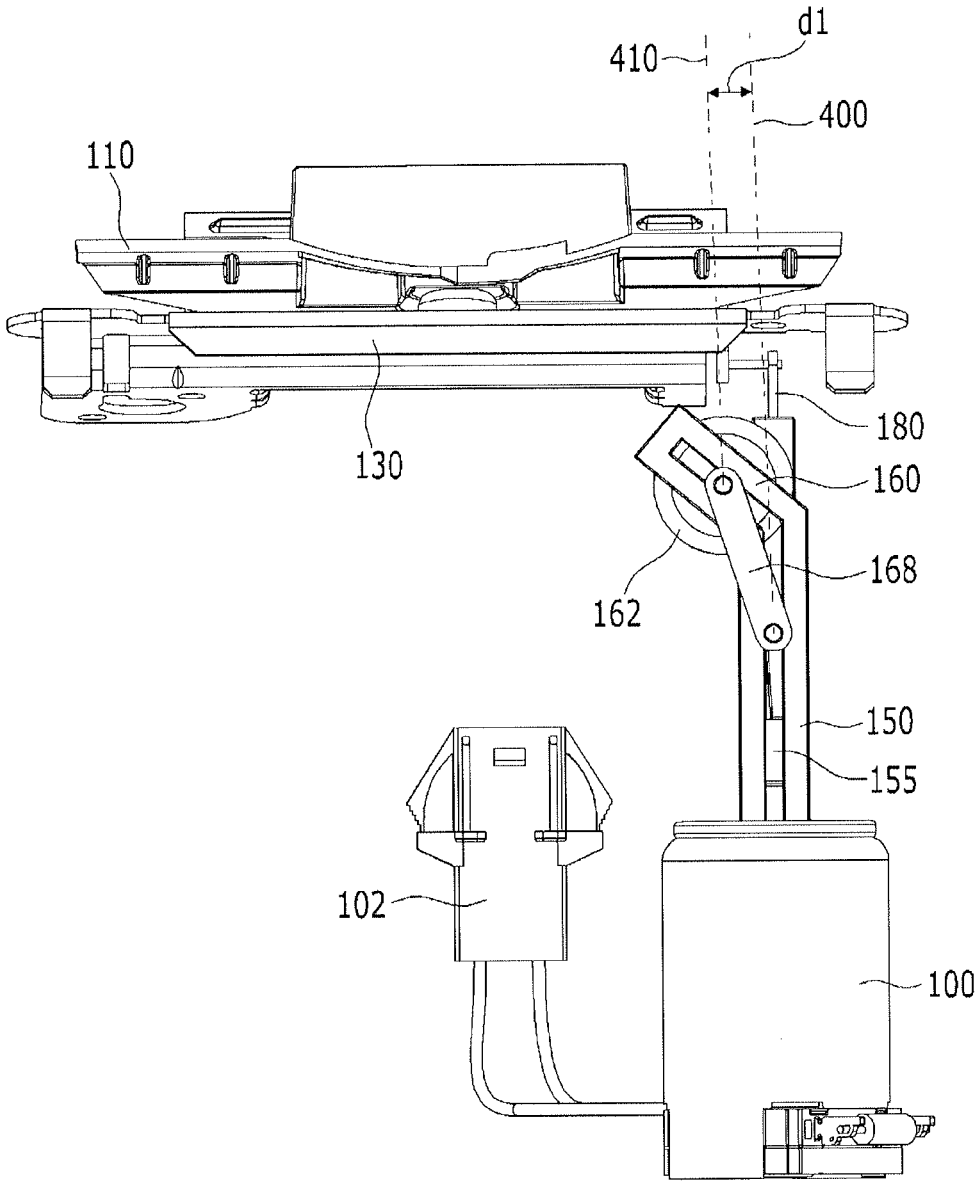
FIG. 4 is a top plan view illustrating a low beam state of a shield unit of the exemplary head light module according to the present invention.
Figure 5:
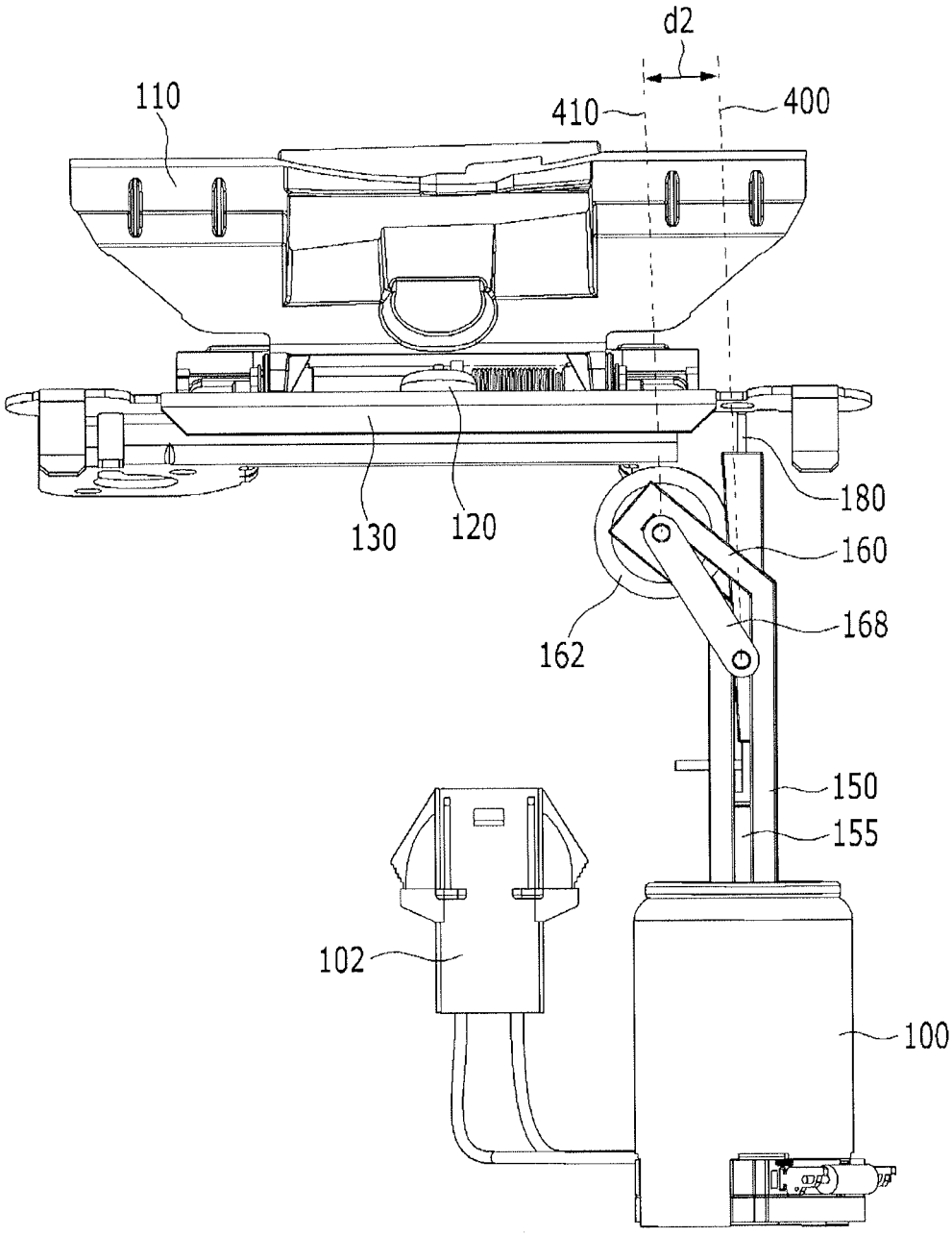
FIG. 5 is a top plan view illustrating a high beam state of the shield unit of the exemplary head light module according to the present invention.

FIG. 4 is a top plan view illustrating a low beam state of a shield unit of the head light module according to various embodiments of the present invention, and FIG. 5 is a top plan view illustrating a high beam state of the shield unit of the head light module according to various embodiments of the present invention.

Referring to FIG. 4, the plunger 164 is moved rearward by the actuator 100 such that the shield 110 blocks the high beam. Further, a first distance difference d1 is formed between a movement line 400 of the plunger 164 and a position 410 of the pad pin 170.

Referring to FIG. 5, the plunger 164 is moved forward by the actuator 100 such that the shield 110 does not block the high beam. Further, a second distance difference d2 is formed between the movement line 400 of the plunger 164 and the position 410 of the pad pin 170, and the first distance difference d1 is smaller than the second distance difference d2.

Referring to FIGS. 4 and 5, a front end portion of the forward and rearward guide 150 and the inclined guide 160 may be joined with each other, and the guide slot 155 of the forward and rearward guide 150 may be connected to the slot of the inclined guide 160.

Figure 6:
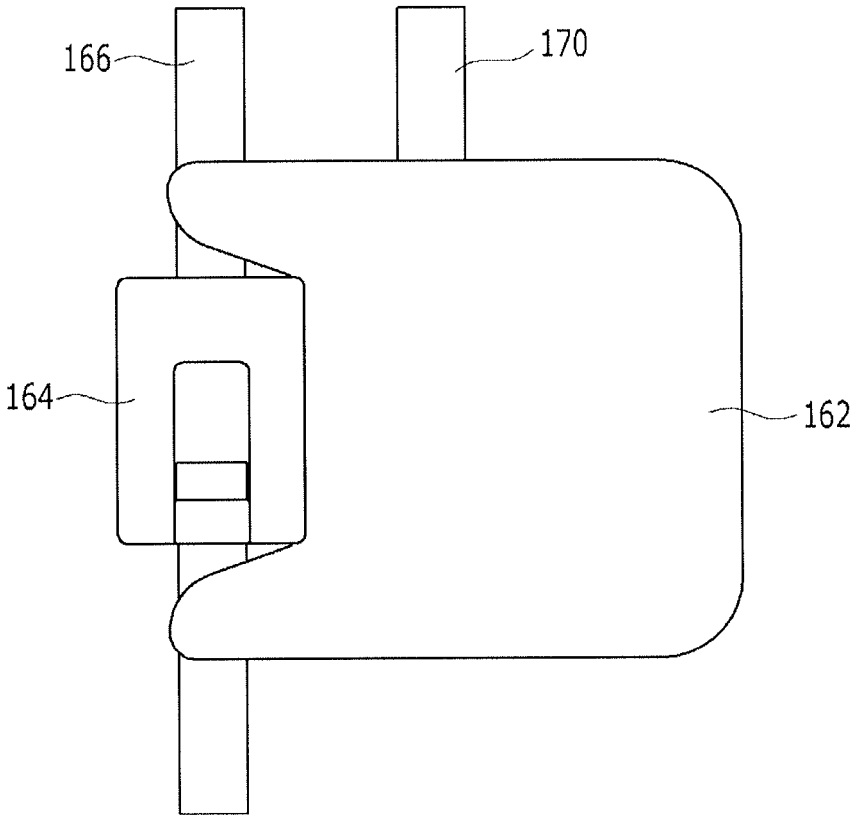
FIG. 6 is a partial detailed view illustrating the low beam state of the shield unit of the exemplary head light module according to the present invention.
Figure 7:
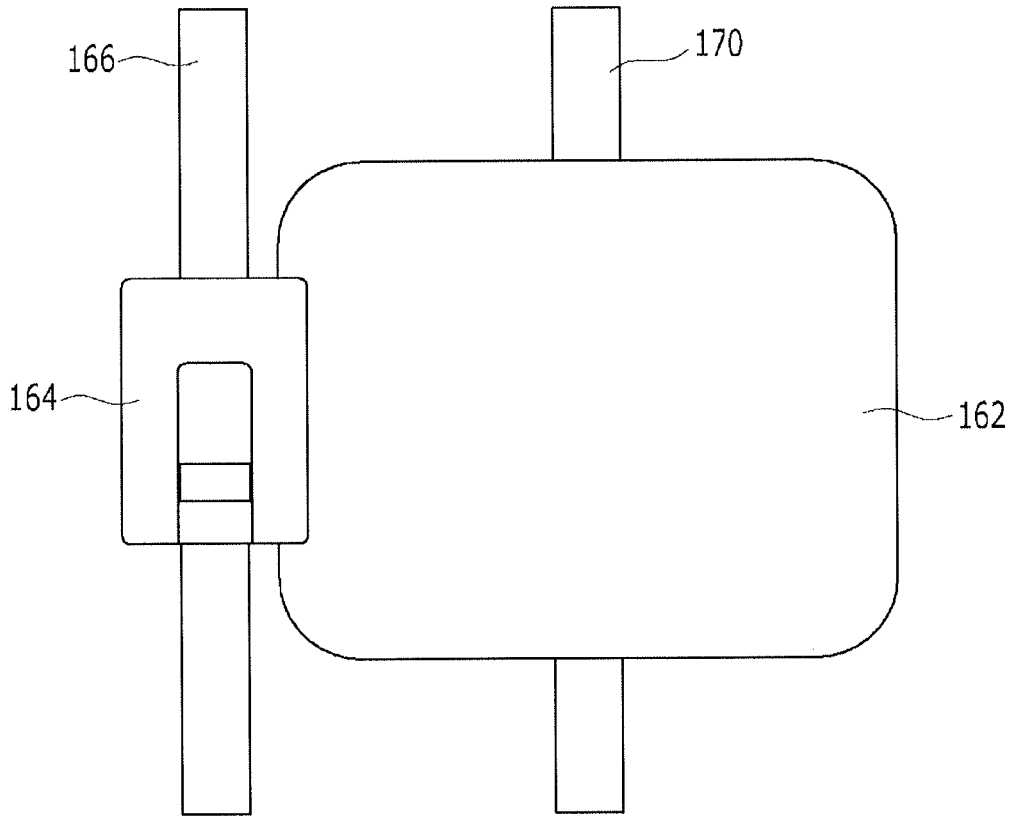
FIG. 7 is a partial detailed view illustrating the high beam state of the shield unit of the head light exemplary module according to the present invention.

FIG. 6 is a partial detailed view illustrating the low beam state of the shield unit of the head light module according to various embodiments of the present invention, and FIG. 7 is a partial detailed view illustrating the high beam state of the shield unit of the head light module according to various embodiments of the present invention.

Therefore, referring to FIG. 6, when the plunger 164 is moved rearward by the actuator 100, an amount of compression by which the compressive roll pad 162 is compressed by one surface of the plunger 164 is large.

Referring to FIG. 7, when the plunger 164 is moved forward by the actuator 100, an amount of compression by which the compressive roll pad 162 is compressed by the one surface of the plunger 164 is small, or the compressive roll pad 162 is not compressed.

Figure 8:
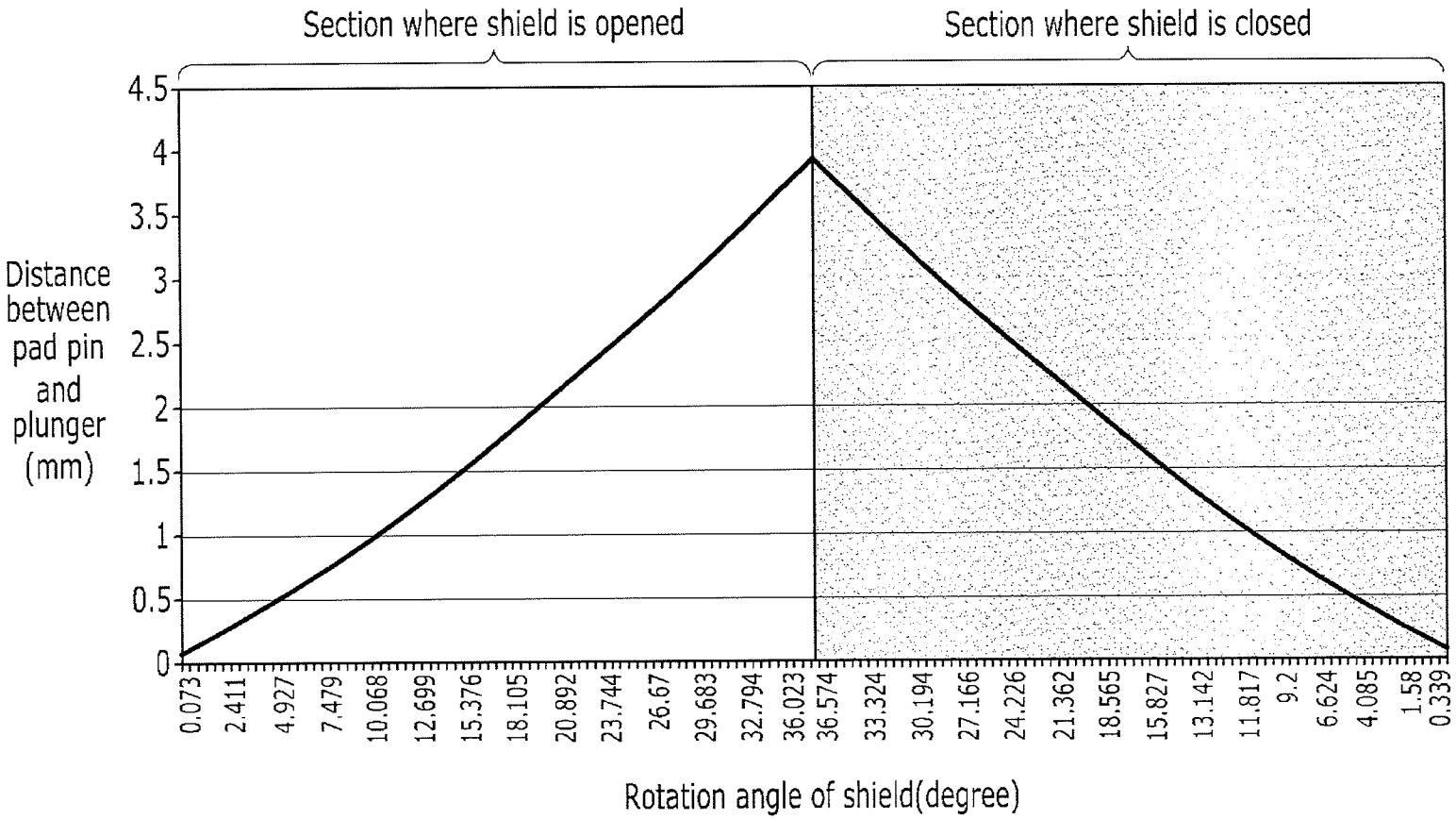
FIG. 8 is a graph illustrating an operation state of the exemplary head light module according to present invention.

FIG. 8 is a graph illustrating an operation state of the head light module according to various embodiments of the present invention.

Referring to FIG. 8, a horizontal axis refers to a rotation angle of the shield 110, and a vertical axis refers to a distance between the pad pin 170 and the plunger 164.

Further, in accordance with the rotation angle of the shield 110, a region of the graph is divided into a section (left side) where the shield 110 is opened, and a section (right side) where the shield 110 is closed.

As illustrated, the distance between the pad pin 170 and the plunger 164 is gradually increased in the section where the shield 110 is opened, and the distance between the pad pin 170 and the plunger 164 is gradually decreased in a section where the shield 110 is closed.

For convenience in explanation and accurate definition in the appended claims, the terms lower, front or rear, and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A head light module comprising:

a lamp disposed to irradiate light;

a shield rotatable about a rotating pin so selectively block a light path of a portion of the light irradiated from the lamp;

a plunger disposed to move in a longitudinal direction thereof in order to push or pull one side of the shield;

a compressive roll pad including an outer circumferential surface in contact with the plunger, rotated in accordance with a forward and rearward movement of the plunger, and compressed by the plunger or returns back to an original shape thereof when the plunger is moved forward or rearward; and an actuator which moves the plunger forward or rearward so that the shield selectively blocks the light path of a portion of the light irradiated from the lamp.

2. The head light module of claim 1, further comprising:

a plunger pin protruding on one side surface of the plunger;

a pad pin disposed on a rotation center portion of the compressive roll pad;

a connecting arm which connects the plunger pin and the pad pin;

a forward and rearward guide which guides the movement of the plunger pin; and an inclined guide which guides movement of the pad pin.

3. The head light module of claim 1, further comprising:

a drive arm having one end portion hinge-coupled to a front end portion of the plunger, and the other end portion hinge-coupled to the shield, such that the plunger rotates the shield.

4. The head light module of claim 1, further comprising:

a shield mounting bracket supporting the shield to be rotatable about the shield rotating pin.

5. The head light module of claim 4, further comprising:

a damper disposed between the shield mounting bracket and the shield to attenuate an impact occurring between the shield mounting bracket and the shield.

6. The head light module of claim 5, wherein:

while the plunger is moved rearward and the shield is rotated about the shield rotating pin, the compressive roll pad is compressed by the plunger, a movement speed of the plunger is reduced by the compression force, and an impact occurring at the damper is reduced.

7. The head light module of claim 5, wherein:

the damper is fixed to the shield mounting bracket, and a rotational operation of the shield is stopped by the damper in accordance with a forward or rearward movement of the plunger.

8. The head light module of claim 1, wherein:

the compressive roll pad is an elastic member capable of being compressed by being pressed by the plunger, and expanded to return back to an original shape thereof.

* * * * *